United States Patent [19]

Dohshita et al.

[11] 4,391,241

[45] Jul. 5, 1983

[54] STOPPING DEVICE FOR ENGINE SUPPLIED WITH FUEL BY FUEL INJECTION PUMP

[75] Inventors: Hidetoshi Dohshita, Okazaki; Yoshiya Ishii, Toyota; Nobuyuki Fujitani, Kariya, all of Japan

[73] Assignee: Nippondenso Co., Ltd., Kariya, Japan

[21] Appl. No.: 208,415

[22] Filed: Nov. 19, 1980

[30] Foreign Application Priority Data

Dec. 21, 1979 [JP] Japan ..... 54-166333

[51] Int. Cl.[3] ..... F02D 17/00

[52] U.S. Cl. ..... 123/198 DB; 123/DIG. 11

[58] Field of Search ..... 123/DIG. 11, 198 DB, 123/510, 514

[56] References Cited

U.S. PATENT DOCUMENTS

| | | | |
|---|---|---|---|
| 3,398,731 | 8/1968 | Johansson | 123/DIG. 11 |
| 4,032,091 | 6/1977 | Reddy | 123/510 |
| 4,187,813 | 2/1980 | Stumpp | 123/510 |
| 4,274,380 | 6/1981 | de Vulpillieres | 123/514 |
| 4,296,718 | 10/1981 | Baugh et al. | 123/DIG. 11 |
| 4,319,550 | 3/1982 | Tshii et al. | 123/198 DB |

FOREIGN PATENT DOCUMENTS

| | | | |
|---|---|---|---|
| 52-17186 | 5/1977 | Japan . | |
| 2001133 | 1/1979 | United Kingdom | 123/DIG. 11 |

*Primary Examiner*—Ira S. Lazarus

*Attorney, Agent, or Firm*—Cushman, Darby & Cushman

[57] ABSTRACT

A stopping device for an engine supplied with fuel by a fuel injection pump including a change-over valve, and an actuator for actuating the change-over valve in response to an engine shutdown operation. The change-over valve is movable between a first position to which it moves at engine startup to connect a fuel tank with an inlet of a fuel supply pump driven by the engine and connect an outlet of the fuel supply pump with an inlet of the fuel injection pump, and a second position to which it moves in response to an engine shutdown operation to connect the inlet of the fuel injection pump with the inlet of the fuel supply pump and connect the outlet of the fuel supply pump with the fuel tank. The actuator includes a solenoid and a key switch operative to energize the solenoid to move the change-over valve to the first position in response to an engine startup operation, hold the change-over valve in the first position during engine operation, and de-energize the solenoid to move the change-over valve to the second position in response to an engine shutdown operation.

7 Claims, 6 Drawing Figures

STOPPING DEVICE FOR ENGINE SUPPLIED WITH FUEL BY FUEL INJECTION PUMP

BACKGROUND OF THE INVENTION

This invention relates to engine stopping devices for internal combustion engines, and more particularly it is concerned with an engine stopping device particularly suitable for use with a diesel engine.

In one type of engine stopping device for an internal combustion engine known in the art, supply of fuel is interrupted by turning off the key switch and at the same time pulling for a predetermined time the stop lever for the fuel injection pump.

Another type of engine stopping device known in the art includes a shut-off valve mounted at the inlet of the fuel injection pump and opened during engine operation and closed when the engine is in the process of being stopped or has stopped.

Some disadvantages are associated with the prior art. In the former device, in the event the plunger or rack of the fuel injection pump is stuck, it would be impossible to pull the stop lever. In the event the governor link is broken, it would also be impossible to stop the engine. An added disadvantage is that the engine tends to restart when an external force is exerted thereon after the stop lever is restored to its original position.

The latter device has the disadvantage that a considerably long time which may be over about one minute with engine idling, for example, elapses after the shut-off valve is closed and before the engine is brought to a complete half following injection of all the fuel collected in the fuel injection pump.

SUMMARY OF THE INVENTION

The present invention has been developed for the purpose of obviating the aforesaid disadvantages of the prior art. Accordingly, the present invention has as its object the provision of an engine stopping device of simple construction capable of stopping the engine in a short time after the key switch is turned off and preventing restarting of the engine by an external force while the engine is shut down.

According to the present invention, there is provided an engine stopping device for an internal combustion engine comprising a change-over valve movable between a first position and a second position, said change-over valve connecting a fuel tank with an inlet of a fuel supply pump driven by the engine and an outlet of the fuel supply pump with an inlet of a fuel injection pump at engine startup and during engine operation when the valve moves to the first position and connecting the inlet of the fuel injection pump with the inlet of the fuel supply pump and the outlet of the fuel supply pump with the fuel tank in response to an engine shutdown operation when the valve moves to the second position, and an actuator for actuating the change-over valve in response to an operation to stop the engine, wherein the engine can be brought to a complete halt, by drawing the fuel collected in the fuel injection pump and returning same to the fuel tank in response to an engine shutdown operation, and wherein restarting of the engine by an external force can be prevented during engine shutdown by keeping the changeover valve in the second position.

DESCRIPTION OF THE PREFERRED EMBODIMENT

Figure 1:
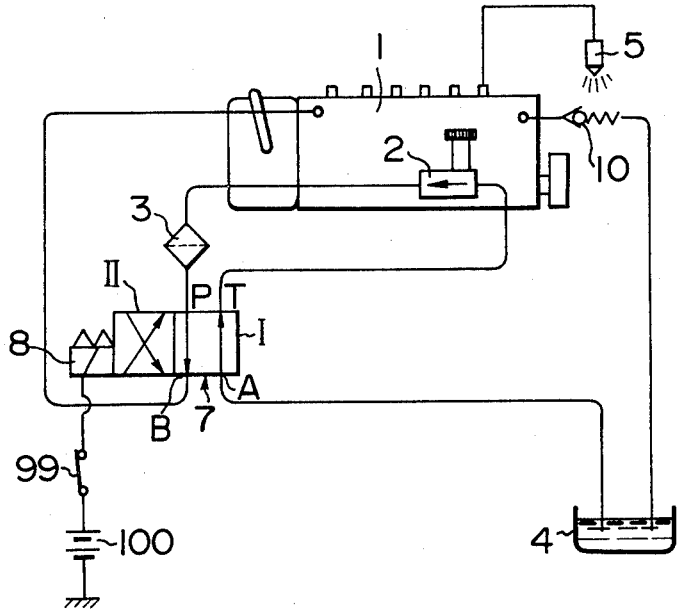
FIG. 1 is a schematic view of the fuel circuit for the engine stopping device according to the present invention.

A referred embodiment of the invention will be described by referring to the drawings.

The embodiment shown in FIG. 1 comprises a fuel injection pump 1 driven by a diesel engine, not shown, for injecting fuel through a nozzle 5 into the engine, a fuel supply pump 2 driven by a cam shaft, not shown, mounted on the fuel injection pump 1, a fuel tank 4, and a change-over valve 7 actuated by a solenoid 8. The solenoid 8 is energized by an engine key switch 99 connected between it and a power source 100.

In the engine stopping device shown in FIG. 1, when the key switch 99 is in an ON position the changeover valve 7 is actuated by the solenoid 8 to move to a first position as shown, in which the valve connects the fuel tank 4 with an inlet of the fuel supply pump 2 and connects an outlet of the fuel supply pump 2 with an inlet of the fuel injection pump 1. The numeral 3 designates a filter.

When the key switch 99 is in an OFF position, the change-over valve 7 moves to a second position in which the valve connects the inlet of the fuel injection pump 1 with the inlet of the fuel supply pump 2 and connects the outlet of the fuel supply pump 2 to the fuel tank via the filter 3.

In the drawings, the numeral 10 designates a check valve for keeping constant the pressure in a fuel sump in the fuel injection pump 1 during engine operation and for preventing flowing back of the fuel from the fuel tank 4 during engine shutdown.

In the engine stopping device of the aforesaid construction, fuel from the fuel tank 4 is introduced into the fuel supply pump 2 through ports A and T of the change-over valve 7, passed through the filter 3, fed to the fuel injection pump 1 through ports P and B of the change-over valve 7, and ejected through the nozzle 5, during engine operation.

As the key switch is brought to an OFF position, the change-over valve 7 moves to a second position in which the fuel collected in the fuel injection pump 1 is drawn by the fuel supply pump 2 through the ports B and T of the change-over valve 7 and returned to the fuel tank 4 through the ports P and A of the change-over valve 7. Thus the engine is positively and quickly brought to a complete halt.

Since the fuel injection pump 1 is driven by the engine, it is driven for a while by inertia of the engine after the key switch 99 is turned off. Thus the fuel supply pump 2 coupled to the fuel injection pump 1 is also driven for a while after the key switch 99 is turned off. The time of operation of the pump 2 at this time is long enough to eject the residual fuel from the fuel injection pump 1.

An actuator electric circuit for the change-over valve of the engine stopping device shown in FIG. 1 will be described by referring to FIG. 2. The solenoid 8 or actuator shown in FIG. 1 includes coils consisting of a pull-in coil 51 and a holding coil 52. The key switch 99 shown in FIG. 1 includes a common terminal 101, an operation terminal 103 corresponding to the operation position of the key switch 99, a starting terminal 104 corresponding to the starting position of the key switch 99, an OFF terminal 102 and a pivotal member 105.

In the electric circuit of the aforesaid construction, when the key switch 99 is turned off, the pivotal member 105 connects the common terminal 101 with the OFF terminal 102, so that the electric circuit is broken.

Figure 2:
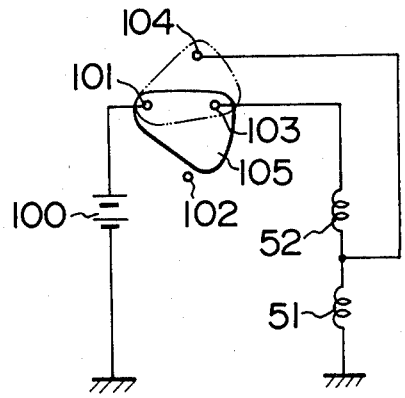
FIG. 2 is a diagram of the electriic circuit for the engine stopping device shown in FIG. 1.

When the key switch 99 is moved to the starting position, the pivotal member 105 connects the common terminal 101 with the starting terminal 104 and connects the common terminal 101 with the operation terminal 103 by moving to a broken-line position shown in FIG. 2.

When the key switch 99 is in the operation position, the pivotal member 105 is moved to connect the common terminal 101 with the operation terminal 103.

When the key switch 99 is in the starting position, the common terminal 101 is connected with the operation terminal 103 and the starting terminal 104, so that these terminals have the same potential. Thus no current is passed to the holding coil 52 and a current is only passed to the pull-in coil 51.

The pull-in coil 51 is designed and constructed such that a current of high value flows thereto to produce a high drawing force to enable the solenoid 8 to have a high initial drawing force. In view of the effect of heating and the need to economize, it is not desirable to pass a current of high value to the pull-in coil 51 at all times. In the circuit shown in FIG. 2, a voltage is impressed only on the operation terminal 103 when the key switch 99 is in the operation position, and the pull-in coil 51 and holding coil 52 are connected in series with each other. By this arrangement, the value of the current can be reduced, generation of heat can be inhibited and operation can be performed economically. Although the drawing force exerted by the solenoid 8 is relatively reduced, the absolute value necessary for the operation is ensured since the solenoid gap has already been reduced.

When the electric circuit is broken, a voltage is impressed only on the OFF terminal 102. However, since the OFF terminal 102 is connected with no terminal, no voltage is impressed on the operation terminal 103 and starting terminal 104. Thus the pull-in coil 51 and holding coil 52 are maintained in an OFF position.

In the electric circuit of the aforesaid construction, the holding coil 52 may be replaced by a resistor.

Figure 3:
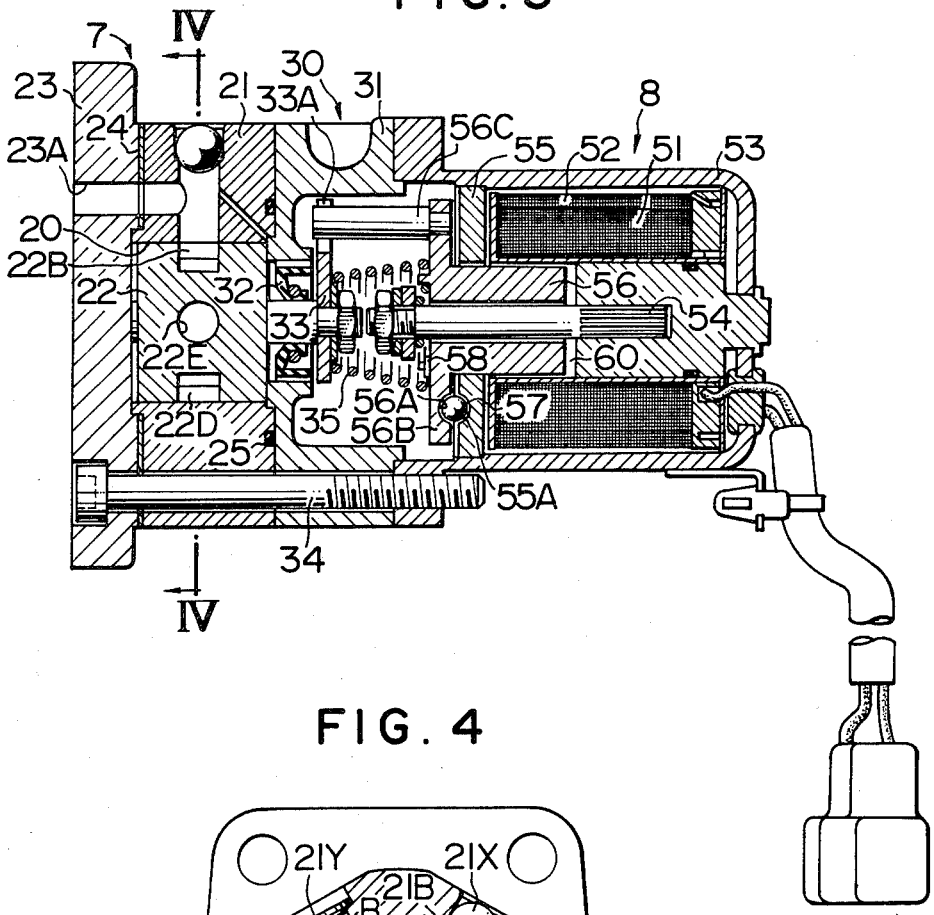
FIG. 3 is a sectional view of the change-over valve of the engine stopping device shown in FIG. 1.

The construction of the change-over valve 7 shown in FIG. 1 will be described in detail by referring to FIGS. 3 and 4.

The change-over valve 7 comprises a valve body 21, a valve member 22 fitted in liquidtight relation in a hole 20 formed in the valve body 21 for rotation therein, and an end plate 23 closing one end of the hole 20 through a gasket 24.

The valve body 21 is formed with four independent radial passages 21A, 21B, 21C and 21D communicating with one another though the hole 20. These passages 21A, 21B, 21C and 21D communicate with a duct 23A formed in the end plate 23 to constitute the ports A, T, B and P respectively which are connected by lines as shown in FIG. 1.

The valve member 22 is formed at its outer periphery with cutouts 22A, 22B, 22C and 22D which are independent of one another. The valve member 22 is formed therein with a passage 22E connecting the cutouts 22A and 22C with each other and a passage, not shown, connecting the cutouts 22B and 22D with each other. The two passages are independent of each other.

The numerals 21X and 21Y designate plugs used for filling the holes formed when the passages 21A, 21B, 21C and 21D are formed.

The solenoid 8 is what is generally referred to as a rotary solenoid and comprises, in addition to the pull-in coil 51 and holding coil 52, a yoke 53, a shaft 54 force fitted in the yoke 53, a cam plate 55 secured to the yoke 53 and formed on its surface with a cam groove 55A, a plunger 56 including a flange 56B formed on its surface with a cam groove 56A fitted for reciprocatory and rotational movements relative to the shaft 54, a ball 57 inserted between the cam grooves 55A and 56A and a torsion spring 58.

The cam grooves 55A and 56A are arcuate in shape engaging each other in such manner that they can be rotated through a predetermined angle (45°, for example) through the ball 57. The cam grooves 55A and 56A are inclined in depth in such a manner that when the plunger 56 moves in reciprocatory movement it also moves in rotational movement.

The torsion spring 58 urges the plunger 56 to rotate in a direction in which a gap 60 between the plunger 56 and yoke 53 is increased.

A connecting portion 30 includes a housing 31 bolted at 34 to the end plate 23 and valve body 21 of the change-over valve 7 and to the yoke 53 of the solenoid 8. The valve member 22 includes a shaft projecting into the housing 31 and having secured thereto a lever 33 formed with an opening 33A receiving therein a pin 56C attached to the flange 56B of the plunger 56. As the plunger 56 rotates while moving in reciprocatory movement, the lever 33 is rotated through the pin 56C to thereby rotate the valve member 22.

A pusher spring 35 urging the plunger 56 to move in a direction in which the gap 60 between the plunger 56 and yoke 53 is reduced is mounted between the lever 33 and the flange 56B of the plunger 56, to prevent floating of the ball 57. In mounting the pusher spring 35, a load is applied thereto beforehand which is small enough relative to the axial force produced by the torsion spring 58 through the cam grooves 55A and 56A, so that rotation of the plunger 56 may not be interfered with by the torsion spring 58.

In the drawings, the numerals 25 and 32 designate an O-ring and an oil seal respectively.

Figure 5:
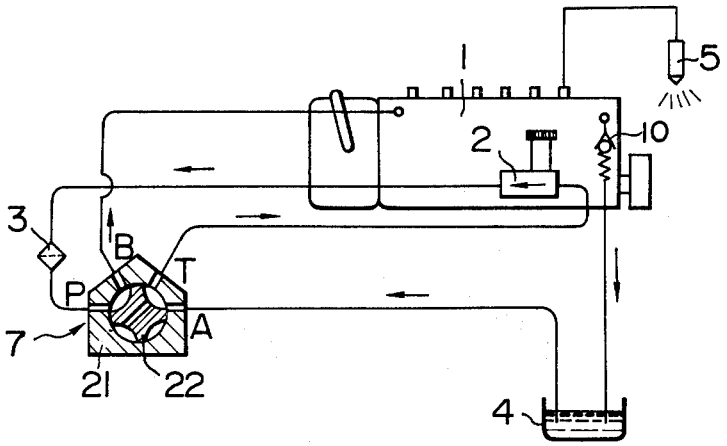
FIG. 5 is a schematic view of the fuel circuit of the engine stopping device according to the present invention with the device being operative.
Figure 6:
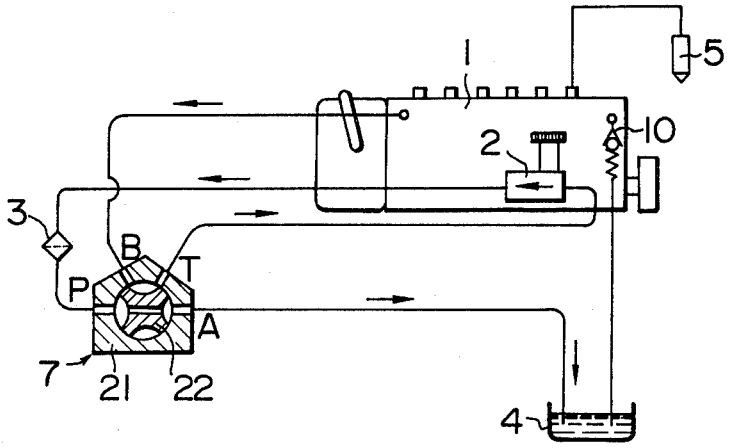
FIG. 6 is a schematic view of the fuel circuit of the engine stopping device according to the present invention with the device being inoperative.

Further detailed construction and operation of the change-over valve 7 will be described. The valve body 21 and valve member 22 are related to each other in such a manner that when the key switch 99 is turned on at engine startup or during engine operation the valve member 22 moves to a first position as shown in FIGS. 1 and 5 and when the key switch 99 is turned off the change-over valve 7 moves to a second position as shown in FIGS. 4 and 6.

More specifically, when the key switch 99 is in the OFF position, the plunger 56 is forced by the torsion spring 58 against one end of the direction of rotation of the cam grooves 55A and 56A, and the gap 60 is maximized in size. At this time, the valve member 22 is in the second position as shown in FIGS. 4 and 5.

When the key switch 99 is in an engine startup position, a current is passed only to the pull-in coil 51 to form a magnetic field between the yoke 53, cam plate 55 and plunger 56, so that the plunger 56 is drawn in the direction in which the gap 60 is reduced in size. At this time, the plunger 56 is guided by the shaft 54 to move axially in sliding movement and at the same time rotated through 45°, for example, by the action of the cam grooves 55A and 56A and ball 57 against the biasing force of the torsion spring 58.

When the key switch 99 is moved to an operation position, a current is passed to the holding coil 52 in addition to the pull-in coil 51. However, the gap 60 has had its size reduced at this time, so that the value of the current is low. Although the drawing force exerted by the pull-in coil 51 is low, the absolute value of the drawing force is higher than at engine startup. Since the drawing force exerted by the holding coil 52 is added, a sufficiently high holding force can be obtained.

From the foregoing description, it will be appreciated that when the change-over valve 7 is in the first position as shown in FIGS. 1 and 5, the fuel tank 4 is connected with the inlet of the fuel supply pump 2 through the ports A and T of the change-over valve 7 and the outlet of the fuel supply pump 2 is connected with the inlet of the fuel injection pump 1 through the ports P and B of the change-over valve 7 to inject the fuel from the fuel tank 4 into the engine.

Figure 4:
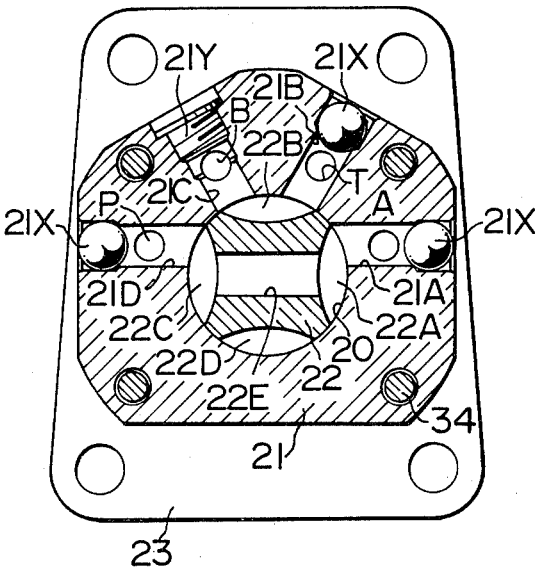
FIG. 4 is a sectional view taken along the line IV—IV in FIG. 3.

When the change-over valve 7 is in the second position as shown in FIGS. 4 and 6, the inlet of the fuel injection pump 1 is connected with the inlet of the fuel supply pump 2 through the ports B and T of the change-over valve 7 and the outlet of the fuel supply pump 2 is connected with the fuel tank 4 through the ports P and A of the change-over valve 7. Thus as the key switch 99 is turned off, the fuel supply pump 2 is driven for a while by inertia of the engine through the fuel injection pump 1, so that the fuel collected in the fuel injection pump 1 is drawn by the fuel supply pump 2 through the ports B and T of the change-over valve 7 and returned to the fuel tank 4 through the ports P and A of the change-over valve 7. This instantaneously interrupts the injection of fuel from the fuel injection pump 1 and brings the engine to a halt in about two seconds of engine idling. While the engine is inoperative, the change-over valve 7 is maintained in the second position shown in FIGS. 4 and 6, so that restarting of the engine by an external force can be avoided.

When the solenoid 8 can exert a sufficiently high drawing force and there is enough reserve for heat generation and current consumption, the pull-in coil 51 and holding coil 52 may be formed into a unitary structure, instead of being formed into separate entities.

The embodiment has been shown and described as using a rotary valve as the change-over valve 7. It is to be understood, however, that the invention is not limited to this specific form of the change-over valve and that a spool valve or a poppet valve may be used in place of the rotary valve. Also, the change-over valve 7 may be replaced by a motor or a linear solenoid.

The present invention can achieve the following effects:

(1) The time required for bringing the engine to a complete halt after the key switch is turned off can be reduced.

(2) No fuel is injected into the engine by the fuel injection pump even if an external force is exerted on the engine while it is inoperative to rotate same, so that inadvertent engine startup can be avoided.

(3) It is possible to positively stop the engine even if sticking of the plunger or control rack of the fuel injection pump or breakage of the governor link occurs.

(4) The fuel supply pump is driven by the engine, so that no excess fuel is drawn off the fuel injection pump and no influences are exerted in restarting of the engine.

What is claimed is:

1. A stopping device for an engine which has a key switch and which is supplied with fuel by a fuel injection pump connected to a fuel tank by a fuel supply pump driven by the engine, comprising:

a change-over valve movable between a first position and a second position, said change-over valve connecting said fuel tank with an inlet of said fuel supply pump and connecting an outlet of said fuel supply pump with an inlet of said fuel injection pump when disposed in the first position, and said change-over valve connecting the inlet of said fuel injection pump with the inlet of said fuel supply pump and connecting the outlet of said fuel supply pump with said fuel tank when disposed in the second position; and an electromagnetic actuator for electromagnetically actuating said change-over valve in response to the position of said engine key switch so that said change-over valve is held in the first and second positions during engine operation and engine shutdown, respectively.

2. An engine stopping device as claimed in claim 1, wherein said actuator comprises a circuit including a pull-in coil and a holding coil connected in series with each other for actuating the change-over valve, said circuit further including said key switch which includes a starting terminal connected between said pull-in coil and said holding coil, an operation terminal connected with said holding coil, an OFF terminal not connected with either of said two coils, and a pivotal member connectable with said terminals, said pivotal member being connected with said starting terminal and said operation terminal to energize said pull-in coil and bring the change-over valve to the first position at engine startup, said pivotal member being connected with said operation terminal to energize said pull-in coil and said holding coil and hold the change-over valve in the first position during engine operation, and said pivotal member being connected with said OFF terminal when the engine is shut down to de-energize said pull-in coil and said holding coil and return the change-over valve to the second position.

3. An engine stopping device as claimed in claim 1, further comprising coils energized and de-energized in response to engine operation and engine shutdown operation respectively, a plunger inserted in said coils for axial reciprocatory movements and rotational movement, a spring urging said plunger in a direction in which the plunger is withdrawn from the coils, cam means for rotating the plunger as the plunger moves axially in reciprocatory movement, and means for transmitting the rotational movement of the plunger to said change-over valve.

4. A stopping device for an engine supplied with fuel by a fuel injection pump connected to a fuel tank by a fuel supply pump driven by the engine, comprising:

a change-over valve movable between a first position and a second position, said change-over valve connecting said fuel tank with a inlet of said fuel supply pump and connecting an outlet of said fuel supply pump with an inlet of said fuel injection pump when disposed in the first position during engine operation, and said change-over valve connecting the inlet of said fuel injection pump with the inlet of said fuel supply pump and connecting the outlet of said fuel supply pump with said fuel tank when disposed in the second position during engine shutdown, said change-over valve including a valve body and a valve member rotatably fitted in a hole formed in said valve body; and an acuator for actuating said change-over valve in response to an engine shutdown operation, said actuator comprising a yoke, a shaft secured to said yoke, a pull-in coil and a holding coil concentrically arranged inside said yoke, a plunger inserted in said coils and guided by said shaft for axial movement and rotational movement, a spring urging said plunger in a direction in which the plunger is withdrawn from the coils, cam means for rotating the plunger as the plunger moves axially, means for transmitting the rotational movement of the plunger to the valve member, said cam means comprising a cam plate secured to said yoke and formed with a cam groove on its surface, a flange integral with said plunger juxtaposed against said cam plate and formed with another cam groove on its surface, and a ball inserted between said cam groove of said cam plate and the cam groove of said flange, and key switch operative to cause engine starting and shutdown operations, said key switch energizing said pull-in coil to move the change-over valve to the first position in response to an engine startup operation, said key switch energizing not only said pull-in coil but also said holding coil to hold the change-over valve in the first position during engine operation and said key switch de-energizing said pull-in coil and said holding coil to move the change-over valve to the second position in response to an engine shutdown operation.

5. A stopping device for an engine supplied with fuel by a fuel injection pump connected to a fuel tank via a fuel supply pump driven by the engine comprising:

a change-over valve movable between a first position and a second position, said change-over valve being adapted to connect said fuel tank with an inlet of said fuel supply pump and to connect an outlet of said fuel supply pump with an inlet of said fuel injection pump when disposed in the first position, said change-over valve being adapted to connect the inlet of said fuel injection pump with the inlet of said fuel supply pump and to connect the outlet of said fuel supply pump with said fuel tank when disposed in the second position;

an engine key switch adapted to be connected to an electric power source and selectively moved to a start position for engine start-up, and operation position for engine normal operation and a shutdown position for engine shutdown;

An electromagnetic actuator including an electric winding adapted to be energized by said electric power source through said key switch to actuate said change-over valve to the first position while said key switch is moved to the start position and to the operation position and de-energized to actuate said change-over valve to the second position while said key switch is moved to the shutdown position; and means connected to said electric winding for limiting electric current flow through said electric winding while said key switch is moved to the operation position to a smaller value than while said key switch is moved to the start position.

6. A stopping device as claimed in claim 5, wherein said current limiting means comprises a further electric winding connected in series with said electric winding and said key switch.

7. A stopping device as claimed in claim 5, wherein said current limiting means comprises a resistor connected in series with said electric winding and said key switch.

* * * * *